United States Patent [19]

Martin

[11] 4,305,273

[45] Dec. 15, 1981

[54] METHOD FOR FORGING LARGE IRREGULAR SHAPES IN A CLOSED-DIE OPERATION IN A CONVENTIONAL OPEN-DIE PRESS

[75] Inventor: Wayne A. Martin, Pittsburgh, Pa.

[73] Assignee: United States Steel Corporation, Pittsburgh, Pa.

[21] Appl. No.: 102,097

[22] Filed: Dec. 10, 1979

[51] Int. Cl.[3] ..... B21D 22/00

[52] U.S. Cl. ..... 72/359; 72/342; 72/364

[58] Field of Search ..... 72/359, 360, 364, 342

[56] References Cited

U.S. PATENT DOCUMENTS

| | | | |
|---|---|---|---|
| 1,381,102 | 6/1921 | Bell | 72/359 |
| 1,889,823 | 12/1932 | Cole | 72/356 |
| 2,499,530 | 3/1950 | Scott | 72/359 X |
| 2,814,101 | 11/1957 | Prough | 72/359 X |
| 3,034,383 | 5/1962 | Schulte | 72/359 |
| 3,289,229 | 12/1966 | Friedman | 72/359 X |
| 3,705,509 | 12/1972 | Haller | 72/45 |
| 3,938,913 | 11/1976 | Metcalfe et al. | 72/342 |
| 4,112,732 | 9/1978 | Okunishi et al. | 72/342 |

*Primary Examiner*—Leon Gilden

*Attorney, Agent, or Firm*—Walter P. Wood; William F. Riesmeyer, III

[57] ABSTRACT

A method and apparatus for forging large irregular shapes in a closed-die operation, particularly for forging a blank to be machined to form a fluid end piece of a pump. The blank has a substantially rectangular parallelepiped body and a block projecting sideways from the body. The apparatus has a die opening of a shape to form the blank. In a single operation in a conventional open-die press a heated workpiece is upset and a portion squeezed sideways to form the block.

4 Claims, 4 Drawing Figures

METHOD FOR FORGING LARGE IRREGULAR SHAPES IN A CLOSED-DIE OPERATION IN A CONVENTIONAL OPEN-DIE PRESS

This invention relates to an improved method and apparatus for forging large irregular shapes in a closed-die operation in a conventional open-die press.

The method and apparatus are particularly useful for forging a steel blank which subsequently is machined to form a fluid end piece of a high-pressure pump. Reference can be made to Rizzone U.S. Pat. No. 3,786,729 of common ownership for an exemplary showing of a pump which has a fluid end piece of the type involved. The fluid end piece includes an integral cylinder, cylinder head and valve pot machined from a single forged blank. The blank consists of a substantially rectangular parallelepiped body and a smaller block projecting from one side of the body. In the machining operation the pump cylinder and cylinder head are formed from the body, and the valve pot from the projecting block. Nevertheless the invention may be used in forging other articles where similar problems are encountered.

Heretofore blanks for fluid end pieces have been flame-cut from steel slabs or have been hammer-forged. Both practices are costly and produce many rejected blanks since sonic requirements are very critical. Desirably the flow lines within the blank curve smoothly from the body into the projecting block, but the flow lines of a flame-cut blank necessarily run straight across.

An object of my invention is to provide an improved method and apparatus for forging a large irregular shape, such as a blank for a fluid end piece, in which I forge the shape in a single closed-die operation.

A further object is to provide an improved method and apparatus for forging a metallurgically sound irregular shape in which the flow lines of the shape curve smoothly into projecting portions.

A further object is to provide closed-die forging apparatus which can be used in a conventional open-die forging press for forging large irregular shapes.

Figure 1:
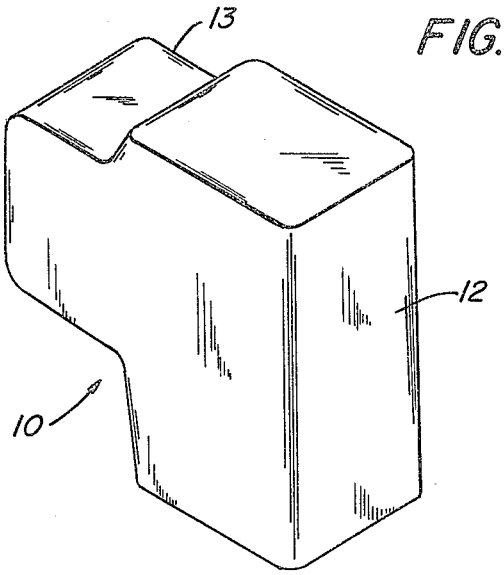
FIG. 1 is an isometric view of a forged blank for a fluid end piece.
Figure 2:
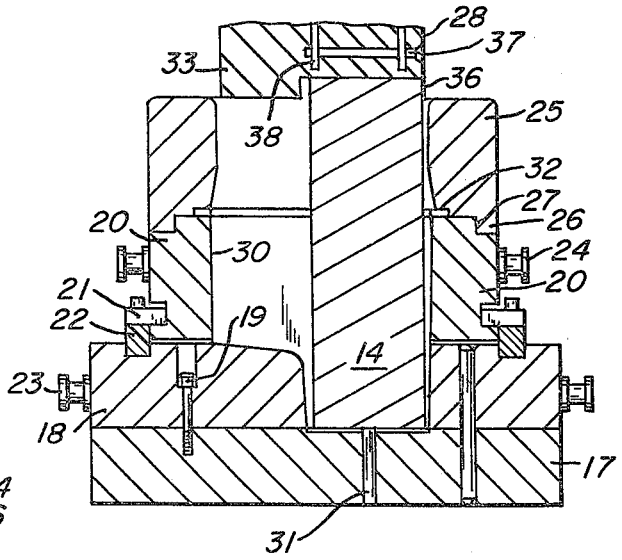
FIG. 2 is a vertical sectional view of the forging apparatus of my invention and a workpiece in place before the beginning of a forging operation.

FIG. 1 shows a forged steel blank 10 of a shape produced by the method and apparatus of my invention. The blank consists of a body 12, which is substantially a rectangular parallelepiped but has a small downward taper, and an integral block 13 projecting from one side of the body. The blank may be machined to form a fluid end piece, as already described. As shown in FIG. 2, the blank is forged from a bloom or billet 14 of rectangular cross section as a workpiece.

Figure 3:
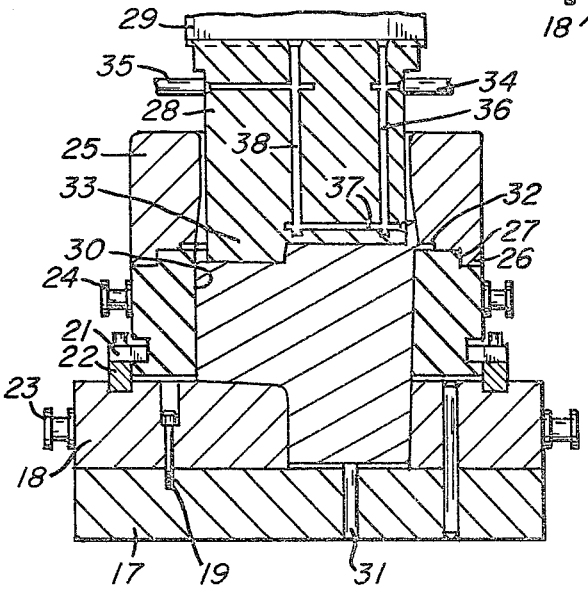
FIG. 3 is a view similar to FIG 2, but showing the apparatus and workpiece at completion of the forging operation.

As shown in FIGS. 2 and 3, the apparatus of my invention comprises a bolster 17 and a bottom die holder 18 fixed to the bolster as with machine screws 19. A bottom die 20 is removably mounted on the bottom die holder 18 with clips 21 carried by locators 22 fixed to the holder. The bottom die holder and bottom die have lifting lugs 23 and 24 respectively. A bottom die adapter 25 overlies the bottom die 20 and has a depending lip 26 which extends around its perimeter and fits within a recess 27 in the die to locate the adapter accurately. A top punch 28 is positioned above the foregoing parts. The apparatus is placed within a conventional open-die forging press (not shown) with the top punch 28 attached to the top die holder 29 of the press.

The bottom die holder 18, bottom die 20 and punch 28 together define an opening of a shape to form the blank 10. The opening is rectangular in cross section. The walls of the opening taper downwardly at a small angle. The die opening has a portion 30 which extends sideways within the bottom die 20 above the upper face of the die holder 18. The block 13 of the blank is formed in this portion of the die opening. The bolster 17 has a vent hole 31 which communicates with the die opening. The adapter 25 has an opening of rectangular cross section to receive the workpiece 14 and top punch 28. The walls of this opening taper upwardly at a small angle. A thin recess 32 is formed between the inside edges of the bottom die 20 and the adapter 25 to accommodate flashings, as hereinafter explained.

The top punch 28 is rectangular in cross section, and has a short downward extension 33 above the portion 30 of the die opening. The top punch has a water inlet 34 and outlet 35 in its opposite side walls. The punch has vertical passages 36 communicating with the inlet 34, horizontal passages 37 communicating with the lower ends of the vertical passages, and other vertical passages 38 communicating with the horizontal passages and leading to the outlet 35.

According to the method of my invention, I place a heated workpiece 14 in the die opening where it fits loosely, as shown in FIG. 2. Initially the top of the workpiece lies slightly above the top of the adapter 25. The workpiece of course is at a suitable temperature for forging, commonly at least 2200° F. I operate the press to bring the top punch 28 down and apply a force against the top of the workpiece. The workpiece is upset, whereby it fills the die opening as shown in FIG. 3. A portion of the workpiece is squeezed sideways into the portion 30 of the die opening to form the block 13. The block 13 is spaced from the bottom of the blank 10 by a distance equal to the thickness of the die holder 18 and from the top by a distance equal to the thickness of the extension 33. A small flashing is formed as the workpiece is upset and is largely accommodated within the recess 32. During the upsetting operation I introduce water to the punch 28 through the inlet opening 34. The water circulates through the passages 36, 37 and 38 and serves to cool localized portions of the punch and minimize flashing between the punch and the adapter 25. The flash that does form between the punch and adapter is chilled in the localized cooling zone and does not seize on the punch.

On completion of the forging operation, I lift the punch 28 and next lift the bottom die 20. In most instances the flashing within the recess 32 supports the forged blank 10 as the bottom die is lifted. The taper facilitates removal of the blank from the bottom die holder 18. After the bottom die and blank are free of the press, I place the blank on any suitable support and release the die, whereupon it drops free of the blank. If the flashing in the recess 32 breaks and does not support the weight of the blank, the blank can be lifted out separately from the bottom die holder. This can also be accomplished by installing a small hydraulic unit (not shown) in the bolster 17 to eject the blank from the bottom die 18.

Figure 4:
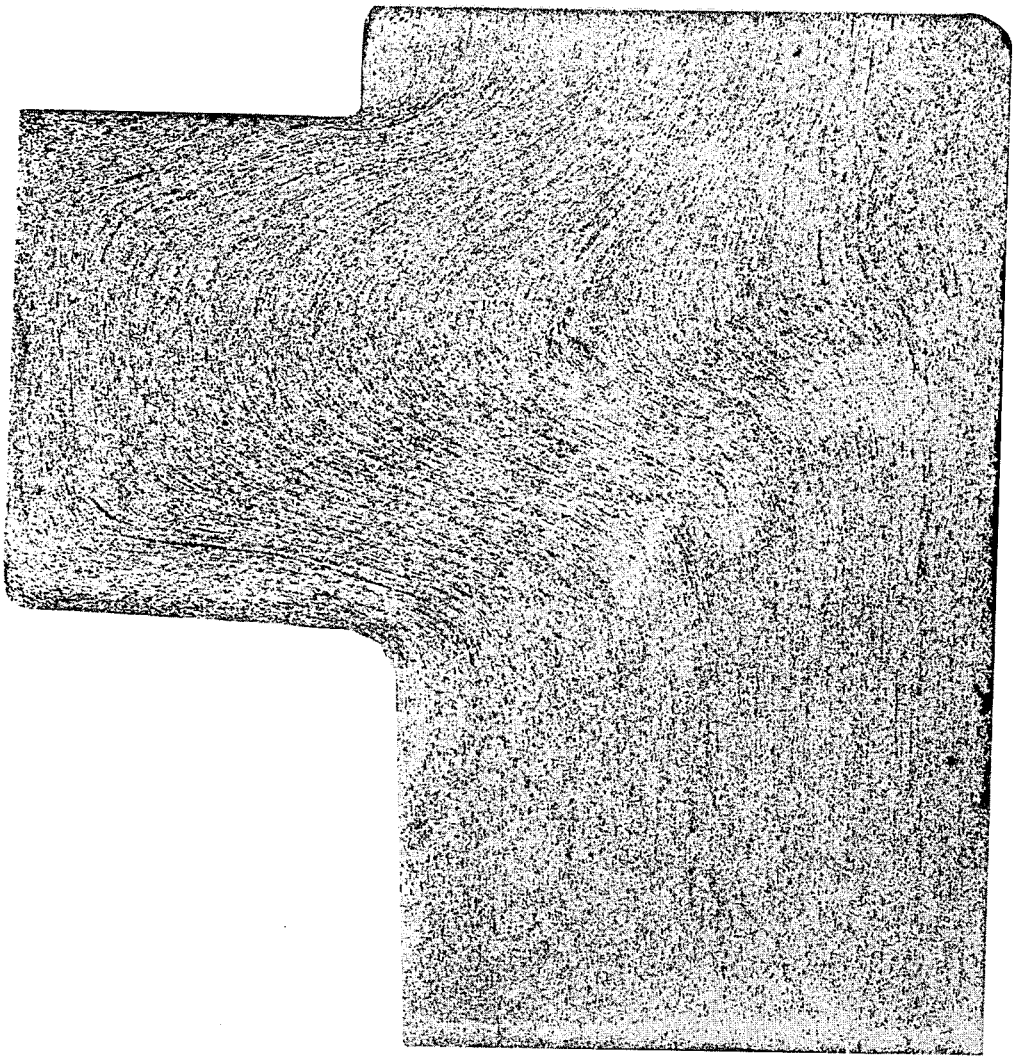
FIG. 4 is a photograph of an etched blank forged in accordance with my invention.

As shown in FIG. 4, the finished blank is metallurgically sound and free of voids. The figure clearly shows flow lines curving smoothly from the body into the projecting block.

From the forgoing description, it is seen that my invention affords a simple method and apparatus for closed-die forging of blanks for machining to form fluid end pieces for pumps or other parts where similar problems are encountered. The apparatus can be used in a conventional press, and the method produces a blank which has metallurgical properties superior to blanks formed by previous methods. The piece is forged in a single upsetting operation, and there is no need for applying separate forces to the sides of the workpiece to form protruding portions.

I claim:

1. Apparatus for forging an irregular shape, which apparatus comprises:

means forming a die opening which has generally vertical sidewalls and a portion for receiving a heated workpiece and a portion extending sideways from said first-named portion; and top punch means positioned above the first-named portion of said die opening for applying force to the top of a workpiece in the die opening and thereby in a single operation upsetting the workpiece and squeezing a portion of the workpiece into the second-named portion of said die opening, said means forming a die opening having a generally horizontal recess on at least the sidewalls defining said first portion, said recess being intermediate top and bottom edges of said die opening to accommodate flashings formed upon upsetting of the workpiece in said first portion.

2. Apparatus as defined in claim 1 in which said die opening has a small downward taper extending to said recess.

3. Apparatus for forming an irregular shape, which apparatus comprises:

means forming a die opening which has generally vertical sidewalls and a portion for receiving a heated workpiece and a portion extending sideways from said first-named portion; and top punch means positioned above the first-names portion of said die opening for applying force to the top of a workpiece in the die opening and thereby in a single operation upsetting the workpiece and squeezing a portion of the workpiece into the second-named portion of said die opening, said top punch means having water passages in the part of the punch means overlying said first-named portion of the die opening for minimizing as well as chilling flashing between said punch means and said means forming the die opening during the forging operation.

4. The apparatus of claim 3 wherein said means forming the die opening has a generally horizontal recess on at least the sidewalls defining said first-named portion, said recess being intermediate top and bottom edges of said means forming the die opening and serving to accommodate flashings formed upon upsetting of the workpiece in said first-named portion.

* * * * *